United States Patent [19]

Chiba et al.

[11] Patent Number: 4,554,087

[45] Date of Patent: Nov. 19, 1985

[54] METAL PROCESSING COMPOSITION

[75] Inventors: Iwane Chiba, Saitama; Junji Fujiwara, Hiroshima; Hiroshi Kuwamoto, Hiroshima; Tomoya izushi, Hiroshima; Toshimi Muto; Haruji Toyama, both of Kanagawa, all of Japan

[73] Assignees: Nippon Kokan Kabushiki Kaisha, Tokyo; Yushiro Chemical Industry Co., Ltd., Osaka, both of Japan

[21] Appl. No.: 695,867

[22] PCT Filed: Jun. 5, 0984

[86] PCT No.: PCT/JP84/00290

§ 371 Date: Jan. 25, 1985

§ 102(e) Date: Jan. 25, 1985

[87] PCT Pub. No.: WO84/04928

PCT Pub. Date: Dec. 20, 1984

[30] Foreign Application Priority Data

Jun. 7, 1983 [JP] Japan ..... 58-100148
May 9, 1984 [JP] Japan ..... 59-91082

[51] Int. Cl.[4] ..... C10M 3/04; C10M 3/38
[52] U.S. Cl. ..... 252/49.9; 252/49.3
[58] Field of Search ..... 252/49.9, 49.3

[56] References Cited

U.S. PATENT DOCUMENTS 3,775,323 11/1973 Dubourg ..... 252/49.9 X
3,788,988 1/1974 Dubourg ..... 252/49.9 X

FOREIGN PATENT DOCUMENTS 56-4696 1/1981 Japan .
56-24494 3/1981 Japan .
56-127690 10/1981 Japan .
57-137390 8/1982 Japan .
58-210999 12/1983 Japan .

*Primary Examiner*—Patrick P. Garvin
*Attorney, Agent, or Firm*—Lowe King Price & Becker

[57] ABSTRACT

The present invention relates to a metal processing lubricant comprising a cationic compound obtained by neutralizing a condensation product between a specific aliphatic dicarboxylic acid and a specific aliphatic basic nitrogen compound with a phosphorus oxy acid or a derivative thereof.

The lubricant of the present invention is water-soluble and excellent in lubricating property, and the change of the lubricating property is slight and degradation of the oiling component is reduced. Accordingly, the industrial value of the lubricant of the present invention is very high.

1 Claim, No Drawings

METAL PROCESSING COMPOSITION

DESCRIPTION

1. Technical Field

The present invention relates to a metal processing composition. More particularly, the present invention relates to a lubricant to be used for rolling, drawing, cutting and grinding of metals.

2. Background Art

Lubricants customarily used for mechanical processing of metals such as rolling, drawing, cutting and grinding are compositions comprising an animal, vegetable or mineral oil as the base oil, a fatty acid or alcohol as an oiliness agent, an organophosphorus or organochlorine compound as the extreme pressure agent and, if required, an emulsifier. The compositions are designed so that the respective ingredients exert a lubricating effect under varying friction conditions produced between a tool and the metal to be processed. Of the above-mentioned ingredients, the oiliness agent has a great influence on the lubricating capacity. As the oiliness agent, fatty acids having about 8 to about 20 carbon atoms, and dimer acids and salts thereof, have been used. In metal processing, such a fatty acid reacts with the metal of the tool and the surfaces of the material to be processed, and is tightly absorbed and arranged on the metal surfaces to exert a good lubricating effect. Accordingly, fatty acids have been used in large quantities. However, the fatty acid naturally reacts with the ground metal powder formed in the processing to form a metal soap, with the result that the fatty acid tends to escape from the lubricating composition. Accordingly, the lubricating capacity changes over time and the stability of the operation is degraded. Moreover, the formed metal soap reduces the stability of the lubricating composition, thus eventually rendering it unusable. In addition, the fatty acid is partially deteriorated by the heat or shearing force generated during metal processing, and therefore, the suspended oil component is degraded and the formed article and processing machine are drastically contaminated, so that cleaning the formed articles and processing machines is highly expensive. In order to obviate these problems caused by the use of a fatty acid type oiliness agent, lubricating compositions are exchanged frequently. At the present, since improvements in processing efficiency, precision and economy are eagerly sought, development of a novel lubricant is strongly desired.

Japanese Patent Laid-Open Publication No. 56-4696 discloses as an additive to a lubricant a compound represented by the following general formula:

$$[R^1—Ar^1(OR^2)_xO]_2POH,$$

wherein $R^1$ stands for an aliphatic hydrocarbon group having about 4 to about 100 carbon atoms, $R^2$ stands for an ethylene group, a trimethylene group, a lower alkyl-substituted ethylene group or a lower alkyl-substituted trimethylene group, $Ar^1$ stands for an aromatic group, and x is an integer of from 1 to 15. When the compound represented by the above general formula is added to a lubricant to be used for rolling, forgoing, hot pressing, blanking, bending, drawing, stretching, cutting, punching or spinning of metals, it serves to improve the rust resistance and extremepressure property of the lubricant.

Japanese Patent Laid-Open Publication No. 56-127690 discloses a phosphate ether having a pH value of 7.5 to 10.5, which is represented by the following general formula:

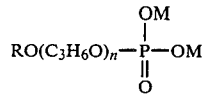

wherein R stands for a hydrocarbon group having 6 to 24 carbon atoms, n is an integer of from 1 to 4, and M stands for a hydrogen atom or a monovalent cation. This compound is used as an additive to an aqueous lubricant composition, and this lubricant composition is used, in turn, for the metal processing. If a lubricant composition containing the above-mentioned phosphate ether is used, the processing speed is increased the life of the processing tool can be prolonged, and a temporary anticorrosive protection is given to the metal to be processed.

Japanese Patent Laid-Open Publication No. 56-24494 discloses a polyamide obtained by reacting at least one compound selected from the group consisting of (A) an aliphatic carboxylic or polycarboxylic acid having at least 12 carbon atoms, (B) an ester of a polycarboxylic acid having at least 4 carbon atoms, which comprises at least one alkyl group having at least 11 carbon atoms and at least one carboxyl group and (C) an amide of a polycarboxylic acid having at least 4 carbon atoms, which comprises at least one alkyl group having at least 11 carbon atoms and at least one carboxyl group with a polyamide. The polyamide can be used as a rolling oil for metals and it has a high rolling capacity. Moreover, the polyamide may be used in the form of a mixture with other lubricating oils.

Japanese Patent Laid-Open Publication No. 57-137390 discloses a cold rolling oil comprising a base oil and a surface active agent, said base oil comprising beef tallow, a synthetic fatty acid formed by heat-polymerizing an unsaturated fatty acid having 18 carbon atoms and an ester of a fatty acid having 8 to 18 carbon atoms with an aliphatic alcohol having 1 to 16 carbon atoms, in which the synthetic fatty acid/ester weight ratio is in the range of 1/1 to 1/20, the synthetic fatty acid content is 1 to 10% by weight and the ester content is 5 to 80% by weight. The cold rolling oil has a superior rolling lubricating property to beef tallow and exerts an effect inhibiting oil stains in the annealing step.

Moreover, Japanese Patent Laid-Open Publication No. 58-210999 discloses a cold strip rolling oil comprising a base oil comprising an animal oil or fat and/or a synthetic ester and a higher fatty acid and/or its derivative, which is added to suppress the acid value below 7.0. This cold rolling oil prevents formation of iron soap by reaction of the higher fatty acid with iron, with the result that an effect inhibiting reduction of the friction coefficient is attained.

DISCLOSURE OF THE INVENTION

Under these circumstances, it is a primary object of the present invention to provide a novel oiling agent which has a higher oiling effect than the conventional fatty acids and in which the defects of the conventional fatty acids are eliminated.

In accordance with the present invention, a metal processing composition which comprises a water-soluble cationic compound obtained by neutralizing a condensation product having an average molecular weight of 500 to 1000, which is obtained by reacting an aliphatic dicarboxylic having 6 to 16 carbon atoms or a dicarboxylic acid mixture comprising (A1) an aliphatic dicarboxylic acid having 6 to 16 carbon atoms and (A2) an aliphatic dicarboxylic acid having 17 to 22 carbon atoms at an (A1)/(A2) molar ratio of from ⅓ to 3/1 with at least one compound having at least two basic nitrogen atoms, which is selected from the group consisting of (a) compounds represented by the following general formula:

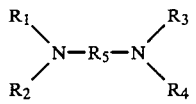

wherein $R_1$ through $R_4$ stand for H or an alkyl group having 1 to 3 carbon atoms, at leat one of $R_1$ through $R_4$ stands for H, and $R_5$ stands for an alkylene group having 1 to 4 carbon atoms, (b) compounds represented by the following general formula:

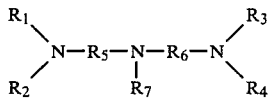

wherein $R_1$ through $R_4$ and $R_7$ stand for H or an alkyl group having 1 to 3 carbon atoms, at least one of $R_1$ through $R_4$ and $R_7$ stands for H, and $R_5$ and $R_6$ stand for an alkylene group having 1 to 4 carbon atoms, (c) compounds represented by the following general formula:

$$H_2N\text{-}(C_2H_4NH)_n\text{-}H$$

wherein n is an integer of from 3 to 5, and (d) hydroxyl group-containing basic nitrogen compounds selected from ethylaminoethanolamine, 1,2-bis(hydroxyethylamino)ethane, 1,3-diamino-2-propanol, 2-hydroxyethylaminopropylamine, N,N'-bis(hydroxyethyl)diethylenetriamine, 2-hydroxypropyltrimethylenetetramine and N-2-hydroxypropyltriethylenetetramine, with at least one phosphorus oxy acid selected from the group consisting of (1) phosphoric acid, phosphorous acid, hypophosphorous acid and perphosphoric acid, (2) a condensed phosphorus oxy acid selected from pyrophosphoric acid, trimetaphosphoric acid, tetrametaphosphoric acid, pyrophosphorous acid, polymetaphosphorous acid and diperphosphoric acid and (3) a compound selected from compounds represented by the following formulae (i) through (iii):

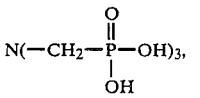

(i)

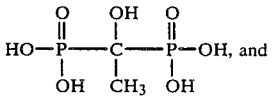

(ii)

-continued

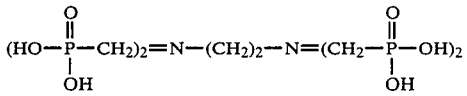

(iii)

is provided.

The above compound is valuable as the oiliness agent and if this condensation product is used alone or in combination with an animal or vegetable oil, a mineral oil and an extreme pressure agent, the lubricating characteristics are greatly improved and the processing operation and its economy can be enhanced.

The active ingredients of the composition of the present invention and the starting materials will now be described in detail.

(Water-Soluble Cationic Compound)

The water-soluble cationic compound as the active ingredient of the composition of the present invention can be easily obtained by neutralizing a condensation product of an aliphatic dicarboxylic acid and an amine with a phosphorus oxy acid.

The water-soluble cationic compound is easily obtained by feeding predetermined amounts of the aliphatic dicarboxylic acid and amine in a steel reactor equipped with a thermometer, a nitrogen gas inlet tube, a stirrer and a reflux condenser provided with a water-removing tube, carrying out dehydration in a nitrogen atmosphere at 160° to 170° C. for 4 to 5 hours under reflux of xylene to form a condensation product, and pouring it into water containing a counter-anion in an amount predetermined from the total amine value of the product to dissolve it in water under stirring while appropriately elevating the temperature.

The average molecular weight of the condensation product should be adjusted within an appropriate range for imparting the solubility and the lubricating capacity and secondary capacities in the metal processing to the water-soluble cationic compound. More specifically, in order to easily impart a water solubility industrially, it is preferable that the average molecular weight of the condensation product be not higher than 1000. If the average molecular weight of the condensation product is higher than 1000, it becomes very difficult to render the cationic compounds water-soluble, and even if this is possible, the water-soluble cationic compound forms a film on the formed article or processing machine when it dries, resulting in reduction of the appearance of the formed product or of operation efficiency of the machine. No substantial effect of improving the lubricating capacity is attained if the average molecular weight is lower than 500, and the expected capacity is obtained when the molecular weight is at least 500. Therefore, it is preferable that the average molecular weight of the condensation product be in the range of from 500 to 1000.

The obtained water-soluble cationic compound is used as a lubricant for the metal processing in the form of an aqueous solution of this compound alone or in combination with the base oil, oiliness agent, extreme pressure agent, emulsifier, rust-preventing agent and antiseptic agent used for customary lubricating compositions, except an anionic compound and a fatty acid at optional mixing ratios.

(Aliphatic Dicarboxylic Acid)

The aliphatic dicarboxylic acids used for the production of the water-soluble cationic compound include linear and branched dicarboxylic acids. These dicarboxylic acids may be saturated or unsaturated.

The aliphatic dicarboxylic acids which can be used include linear and branched saturated and unsaturated dicarboxylic acids and dimer acids having 2 to 22 carbon atoms. When the condensation product between the dicarboxylic acid and the basic nitrogen compound is converted into the water-soluble cationic compound by using the counter-anion, no satisfactory water solubility can be given if the carbon atom number exceeds 16. Accordingly, it is preferable that the carbon atom number be up to 16 in order to impart the desired water solubility. If the carbon atom number is smaller than 6, no desired lubricating capacity can be given. Accordingly, it is preferable that the carbon atom number be at least 6 in order to impart the desired lubricating capacity.

In the present invention, a mixture of (A1) a dicarboxylic acid having 6 to 16 carbon atoms and (A2) a dicarboxylic acid having 17 to 22 carbon atoms may be used.

When the condensation product of the aliphatic dicarboxylic acid with the basic nitrogen compound is neutralized with the counter-anion to convert it into the water-soluble cationic compound, the expected lubricating capacity cannot be attained, if the dicarboxylic acid (A1) alone is used, and no sufficient water solubility can be attained if the dicarboxylic acid (A2) alone is used. The preferred (A1)/(A2) molar ratio is in the range of 3/1 to $\frac{1}{3}$. If the content of (A1) is higher than the above range, the lubricating capacity is reduced, while the water solubility becomes insufficient if the content of (A2) is higher than the above range.

(Amines)

A compound having at least two basic nitrogen atoms is used as the amine for the production of the water-soluble cationic compound, and a compound capable of being condensed with the aliphatic dicarboxylic acid. However, if the amine has an alkyl substituent, it is preferable that the carbon atom number of the alkyl group be up to 3 and the carbon atom number of the alkylene group be up to 4 in order to obtain a good water-soluble compound.

Preferred amines include hydroxyl group-containing basic compounds such as ethylaminoethanolamine, 1,2-bis(hydroxyethylamino)ethane, 1,3-diamono-2-propanol, 2-hydroxyethylaminopropylamine, N,N'-bis(-hydroxyethyl)diethylenetriamine, 2-hydroxypropyltrimetylenetetramine and N-2-hydroxypropyltriethylenetetramine.

(Condensation Reaction)

In the condensation reaction between the aliphatic dicarboxylic acid and the amine, the molar ratio of the reactants may be in the range of $\frac{1}{2}$ to 2/1, but it is preferable that the molar ratio be in the range of 1/1 to 1/1.5 in order to obtain a product having a valuable lubricating property and water solubility.

(Counter-Anion)

The counter-anions used for neutralizing the condensation product and obtaining the water-soluble cationic compound include organic acid ions such as an acetate ion, an oxalate ion and a citrate ion, and inorganic acid ions such as a chloride ion, a nitrate ion, a sulfate ion, a phosphorus oxy acid ion and a borate ion. The phosphorus oxy acid ion is preferred for imparting a valuable lubricating capacity and rust resistance, and other counter-anions are insufficient in either or both of the lubricating capacity and rust resistance and therefore are not suitable. The amount of the phosphorus oxy acid is 20 to 100 molar %, preferably 50 to 100 molar %, based on the basic nitrogen atom, exclusive of the amide nitrogen atom, in the condensation product.

(Application Method)

The obtained water-soluble cationic compound is used as a lubricant for the metal processing in the form of an aqueous solution of this compound alone or in combination with the base oil, oiliness agent, extreme-pressure agent, emulsifier, rust-preventing agent and antiseptic agent used for customary lubricating compositions, except an anionic compound and a fatty acid, at optional mixing ratios.

EFFECT OF THE INVENTION

The metal processing composition of the present invention is excellent in lubricating property and is characterized by the absence of troubles observed in a conventional composition comprising a fatty acid type oiliness agent, such as change and reduction of the fatty acid concentration and promotion of degradation of the oil component by formation of a metal soap.

BEST MODE FOR CARRYING OUT THE PRESENT INVENTION

The present invention will now be described with reference to the following examples which are given only for illustration and by no means limit the scope of the invention. In the examples, all "parts" and "%" are by weight. Preferred examples of the starting materials are shown in Table 1.

TABLE 1

| Composition No. | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| Aliphatic dicarboxylic acid (A) | succinic acid | succinic acid | adipic acid | adipic acid | sebacic acid | 1,10 dicarboxy-decane | ← | ← | ← | ← | 1,10-dicarboxy-decane | ← | ← | ← |
| Nitrogen compound (B) | triethylene-tetramine | diethylene-triamine | diethylene-triamine | N—hexylpro-panediamine | diethylene-triamine | triethylene-tetramine | ← | ← | ← | ← | triethylene-tetramine | ← | ← | ← |
| Molar ratio (A/B) | 2/3 | 2/3 | 2/3 | 2/3 | 1/1 | 2/3 | ← | ← | 2/1 | 1/1 | 1/2 | 2/3 | ← | ← |
| Average molecular weight | 570 | 430 | 520 | 660 | 850 | 790 | ← | ← | 560 | 890 | 480 | 790 | ← | ← |
| Counter-anion | phosphoric acid | phosphoric acid | phosphoric acid | phosphoric acid | phosphoric acid | phosphoric acid | ← | ← | ← | ← | phosphoric acid | phosphorous acid | pyrophos-phoric acid | pyrophos-phorous acid |
| Molar % of counter-anion based on basic nitrogen | 75 | 75 | 75 | 100 | 75 | 20 | 50 | 100 | 100 | 75 | 75 | ← | ← | ← |
| Water solubility[1] | S | S | S | NS | S | NS | S | S | NS | S | S | S | S | S |
| pressure resistance[2] ($Kg/cm^2$) | 5.0 | 5.0 | 7.0 | — | 13.0 | — | 18.5 | 18.0 | — | 19.0 | 7.5 | 18.5 | 18.5 | 18.5 |

| Composition No. | 15 | 16 | 17 | 18 | 19 | 20 | 21 | 22 | 23 | 24 | 25 | 26 | 27 |
|---|---|---|---|---|---|---|---|---|---|---|---|---|---|
| Aliphatic dicarboxylic acid (A) | ← | 1,10-dicar-bozydecane | ← | ← | 1-n-butyl-1,6-dicar-boxyhexane | 1,14-dicar-boxy-7-tetradecene | 1,18-dicar-boxybexade-cane | ← | ← | ← | adipic acid/ 1,10-dicar-boxydecane | 1,10-dicar-boxydecane | ← |
| Nitrogen compound (B) | ← | triethylene-tetramine | ← | ← | tetraethy-lene-pentamine | triethylene-tetramine | diethylene-triamine | pentaethyl-enehexamine | ← | ← | triethylene-tetramine | diethylene-triamine/ triethylene-tetramine | N—2-hydroxy-propyltri-ethylene-tetramine |
| Molar ratio (A/B) | ← | 2/3 | ← | ← | ← | ← | 2/3 | ← | 1/2 | 1/1 | (1/1)/3 | 2/ (1.5/1.5) | 2/3 |
| Average molecular weight | ← | 790 | ← | ← | 890 | 900 | 880 | 1250 | 700 | 1320 | 710 | 740 | 930 |
| Counter-anion | 1-hydroxy-ethyli-dene-1,1-diphos-phonic acid | acetic acid | hydrochloric acid | boric acid | phosphoric acid | ← | phosphoric acid | ← | ← | ← | ← | phosphoric acid | ← |
| Molar % of counter-anion based on basic nitrogen | ← | 75 | ← | 100 | 75 | 100 | 100 | ← | ← | ← | 75 | 75 | 100 |
| Water solubility[1] | S | S | S | D | S | S | D | NS | D | NS | S | S | S |
| Pressure resistance[2] | 17.5 | 7.0 | 9.0 | 18.5 | 19.5 | 19.5 | 20.0 | — | 16.5 | — | 17.5 | 18.5 | 19.5 |

TABLE 1-continued

| (Kg/cm$^2$) | | | | | | | | |
|---|---|---|---|---|---|---|---|---|
| | Composition No. | 28 | 29 | 30 | 31 | 32 | Comparison 1 | Comparison 2 |
| | Aliphatic dicarboxylic acid (A) | ← | ← | ← | 1,10-dicarboxydecane | ← | oleic acid-triethanolamine soap | dimer acid-triethanolamine soap |
| | Nitrogen compound (B) | diaminopropane/triethylenetetramine | methyliminobispropylamine | tetramethylenediamine/diethylenetriamine | bishexamethylenetriamine/triethylenetetramine | N—hexylpropanediamine/triethylenetetramine | — | — |
| | Molar ratio (A/B) | 2/(1.5/1.5) | 2/3 | 2/(1.5/1.5) | 2/(1.5/1.5) | ← | — | — |
| | Average molecular weight | 690 | 780 | 640 | 860 | 790 | — | — |
| | Counter-anion | ← | ← | ← | phosphoric acid | ← | — | — |
| | Molar % of counter-anion based on basic nitrogen | ← | 75 | 100 | 100 | ← | — | — |
| | Water solubility[1] | S | S | S | NS | NS | S | S |
| | Pressure resistance[2] (Kg/cm$^2$) | 19.0 | 18.5 | 16.5 | — | ← | 6.5 | 17.5 |

Note
[1]Water Solubility
The sample was added to water at 50° C. at a concentration of 5%, and the mixture was stirred and the dissolution state was examined.
S: dissolved (transparent)
D: dispersed (opaque)
NS: not dissolved
[2]Pressure Resistance
The load carrying capacity of a 5% aqueous solution of the sample at 50° C. was determined by using a fourball tester (Soda type) at a rotation number of 200 rpm.

EXAMPLE 1

A 2.5% aqueous solution of a product obtained by neutralizing a condensation product (having an average molecular weight of 890) of 1.0 mol of 1,10-dicarboxydecane and 1 mol of triethylenetetramine with phosphoric acid (0.75 molar % of phosphoric acid based on the basic nitrogen) was used as the lubricating liquid for cutting of a cast-iron brake drum.

The frequency of tool exchange due to wear was reduced by 25% as compared with the frequency in the case of a conventional lubricating liquid, and occurrence of problems such as the liquid separation and putrefaction over time, observed in a conventional lubricating liquid, was not observed at all and the life of the lubricating liquid could be prolonged.

EXAMPLE 2

A composition comprising 20 parts of a product obtained by neutralizing a condensation product (having an average molecular weight of 790) of 2 mol of 1,10-dicarboxydecane and 3 mol of triethyleneteramine with phosphoric acid (50 molar % of phosphoric acid based on the basic nitrogen), 5 parts of pentaerythritol sesquioleate, 3 parts of an ester of polyethylene glycol having a molecular weight of 400 with beef tallow fatty acids, 30 parts of a machine oil and 40 parts of water was diluted 40-fold with tap water, and the dilution was used as a lubricant for cutting of a cast-iron brake drum.

The frequency of tool exchange due to wear was reduced by 20% as compared with the case of a conventional lubricating liquid, and the liquid separation over time, observed in conventional lubricating liquids, was not observed.

EXAMPLE 3

A 1.0% aqueous solution of a product obtained by neutralizing a condensation product (having an average molecular weight of 790) of 2 mol of 1,10-dicarboxydecane and 3 mol of triethylenetetramine with phosphoric acid (100 molar % of phosphoric acid based on the basic nitrogen) was used for grinding of a steel crankshaft.

The number of articles ground before repolishing of the grinding stone was required was 5 times that of articles ground using a conventional lubricating liquid. Furthermore, the ground powder formed by grinding flew well in the liquid and did not accumulate. Accordingly, recovery and cleaning of the lubricating liquid could be performed very easily and contamination of the grinding stone and the surrounding portion of the machine was reduced.

EXAMPLE 4

A 2.5% aqueous solution of a product obtained by neutralizing a condensation product (having an average molecular weight of 740) of 1 mol of adipic acid, 1 mol of 1,10-dicarboxydecane and 3 mol of triethylenetetramine with phosphoric acid (75 molar % of phosphoric acid based on the basic nitrogen) was used as a lubricant for grinding of steel.

When the contact arc length between the grinding stone and the material to be ground was 25 mm, the grinding resistance was reduced by 21% as compared with the case of a conventional lubricating liquid.

EXAMPLE 5

A 0.1% aqueous solution of a product obtained by neutralizing a condensation product (having an average molecular of 790) of 2 mol of 1,10-dicarboxydecane and 3 mol of triethylenetetramine with phosphoric acid (75 molar % of phosphoric acid based on the basic nitrogen) was used as the lubricating liquid for cold rolling of steel plates.

When the reduction ratio was 50%, the rolling load was reduced by 10% as compared with the rolling load in the case of a conventional lubricating oil.

EXAMPLE 6

Compositions (A) through (C) shown in Table 2, which comprised a product obtained by neutralizing a condensation product (having an average molecular weight of 740) of 2 mol of 1,10-dicarboxydecane, 1.5 mol of diethylenetriamine and 1.5 mol of triethylenetetramine with phosphoric acid (75 molar % of phosphoric acid based on the basic nitrogen), machine oil and water were used as the lubricating liquid for cold rolling of steel.

When the reduction ratio was 50%, the roling load was reduced by at least 10% as compared with the one in the case of a conventional lubricating oil, and contamination of the roll and products was greatly reduced. Furthermore, even when the rolled sheets were annealed under ordinary conditions, sheets free of carbon contamination were obtained.

TABLE 2

| | Composition A | Composition B | Composition C | Conventional Lubricating Oil |
|---|---|---|---|---|
| Phosphoric Acid Neutralization Product (parts) | 0.005 | 0.030 | 0.100 | |
| Machine Oil (parts) | 3.0 | 3.0 | 3.0 | 2.0 |
| $C_8$ Fatty Acid Ester (parts) | — | — | — | 1.0 |
| $C_{18}$ Fatty Acid (parts) | — | — | — | 0.1 |
| Emulsifier (parts) | — | — | — | 0.1 |
| Water (parts) | 97 | 97 | 97 | 97 |
| Rolling Load ($Kg/mm^2$) at Reduction Ratio of 50% | 79.1 | 77.8 | 76.1 | 88.4 |

EXAMPLE 7

A 2.5% aqueous solution of a product obtained by neutralizing a condensation product (having an average molecular weight of 710) of 1.5 mol of sebacic acid, 0.5 mol of 1,18-octadecanedicarboxylic acid and 3 mol of diethylenetriamine with phosphoric acid was used as the lubricating liquid for cutting of a cast-iron brake drum.

The frequency of tool exchange due to wear was reduced by 35% as compared with the case of a conventional lubricating liquid, and occurrence of problems such as liquid separation and putrefaction over time, observed in conventional lubricating liquids, was not observed at all and the life of the lubricating liquid could be prolonged.

EXAMPLE 8

A composition comprising 20 parts of a product obtained by neutralizing a condensation product (having an average molecular weight of 910) of 1 mol of sebacic acid, 1 mol of 1,18-octadecanedicarboxylic acid and 3 mol of triethyleneteramine with phosphoric acid, 5 parts of pentaerythritol sesquioleate, 3 parts of an ester of polyethylene glycol having a molecular weight of 400 with beef tallow fatty acids, 30 parts of machine oil and 40 parts of water was diluted 40-fold with tap water, and the dilution was used as a lubricant for cutting of a cast-iron brake drum.

The frequency of tool exchange due to wear was reduced by 30% as compared with the case of a conventional lubricating liquid, and the liquid separation over time, observed in conventional lubricating liquids, was not observed.

EXAMPLE 9

A 1.0% aqueous solution of a product obtained by neutralizing a condensation product (having an average molecular weight of 930) of 1 mol of adipic acid, 1 mol of 1,16-hexadecanedicarboxylic acid and 1.5 mol of triethylenetetramine with phosphoric acid was used for grinding of a steel crankshaft.

The number of articles ground before repolishing of the grinding stone was required was 7 times that of articles ground using a conventional lubricating liquid. Furthermore, the ground powder formed by grinding flew well in the liquid and did not accumulate. Accordingly, recovery and cleaning of the lubricating liquid could be performed very easily and contamination of the grinding stone and the surrounding portion of the machine was reduced.

EXAMPLE 10

A 2.5% aqueous solution of a product obtained by neutralizing a condensation product (having an average molecular weight of 675) of 1 mol of adipic acid, 1 mol of 1,16-hexadecanedicarboxylic acid and 1.5 mol of tetramethylenediamine with phosphoric acid was used as a lubricant for grinding of steel.

When the contact arc length between the grinding stone and the material to be ground was 25 mm, the grinding resistance was reduced by 25% as compared with the case of a conventional lubricating liquid.

EXAMPLE 11

A 0.1% aqueous solution of a product obtained by neutralizing a condensation product (having an average molecular weight of 910) of 1 mol of sebacic acid, 1 mol of 1,18-octadecanedicarboxylic acid and 3 mol of triethylenetetramine with phosphoric acid was used as the lubricating liquid for cold rolling of steel plates.

When the reduction ratio was 50%, the rolling load was reduced by 15% as compared with the rolling load in the case of a conventional lubricating oil.

EXAMPLE 12

Compositions (A) through (C) shown in Table 3, which comprised a product obtained by neutralizing a condensation product (having an average molecular weight of 910) of 1 mol of sebacic acid, 1 mol of 1,18-octadecanedicarboxylic acid and 3 mol of triethylenetetramine with pyrophosphoric acid, machine oil and water were used as the lubricating liquid for cold rolling of steel.

When the reduction ratio was 50%, the rolling load was reduced by at least 15% as compared with the rolling load in the case of the conventional lubricating oil, and contamination of the roll and products was greatly reduced. Furthermore, even when the rolled sheets were annealed under ordinary conditions, sheets free of carbon contamination were obtained.

TABLE 3

| | Composition A | Composition B | Composition C | Conventional Lubricating Oil |
|---|---|---|---|---|
| Phosphoric Acid Neutralization Product (parts) | 0.005 | 0.030 | 0.100 | |
| Machine Oil (parts) | 3.0 | 3.0 | 3.0 | 2.0 |
| $C_8$ Fatty Acid Ester (parts) | | | | 1.0 |
| $C_{18}$ Fatty Acid (parts) | | | | 0.1 |
| Emulsifier (parts) | | | | 0.1 |
| Water (parts) | 97 | 97 | 97 | 97 |
| Rolling Load ($Kg/mm^2$) at Reduction Ratio of 50% | 75.1 | 73.6 | 72.8 | 88.4 |

Examples 7 through 12, other Examples and Referential Examples are shown in Table 4.

TABLE 4

| Composition No. | Examples 7 | 8 | 9 | 10 | 11 | 12 | 13 | 14 |
|---|---|---|---|---|---|---|---|---|
| Aliphatic dicarboxylic acid (A) | | | | | | | | |
| $A_1$ | sebacic acid | sebacic acid | adipic acid | adipic acid | sebacic acid | sebacic acid | 1-propylo-ctane-1,8-dicarboxylic acid | 7-tetra-decene-1,14-dicar-boxylic acid |
| $A_2$ | 1,18-octade- | 1,18-octa- | 1,16-hexade- | 1,16-hexa- | 1,18-octa- | 1,18- | 6-ethylhexa- | 1,16-hexa- |

TABLE 4-continued

| | | | | | | | | |
|---|---|---|---|---|---|---|---|---|
| | canedicarboxylic acid | decanedicarboxylic acid | canedicarboxylic acid | decanedicarboxylic acid | decanedicarboxylic acid | octadecane dicarboxylic acid | decane-1,16-dicarboxylic acid | decanedicarboxylic acid |
| $A_1/A_2$ | 3/1 | 1/1 | 1/1 | 1/1 | 1/1 | 1/1 | 1/1 | 1/1 |
| Nitrogen compound (B) | diethylenetriamine | triethylenetetramine | diethylenetriamine/triethylenetetramine (1.5/1.5) | tetramethylenediamine/diethylenetriamine (1.5/1.5) | triethylenetetramine | triethylenetetramine | N—2-hydroxypropyltriethylenetetramine | triethylenetetramine |
| Molar ratio (A/B) | 2/3 | 2/3 | 2/3 | 2/3 | 2/3 | 2/3 | 2/3 | 2/1 |
| Average molecular weight | 710 | 910 | 930 | 675 | 910 | 910 | 980 | 750 |
| Counter-anion | phosphoric acid | phosphoric acid | phosphoric acid | phosphoric acid | phosphoric acid | pyrophosphoric acid | pyrophosphoric acid | pyrophosphorous acid |
| Water solubility[1] | S | S | S | S | S | S | S | S |
| Pressure resistance[2] ($Kg/cm^2$) | 20.0 | 20.0 | 20.0 | 20.0 | 20.0 | 20.0 | 20.0 | 20.0 |

| Composition | Examples | | | | Comparative Examples | | | |
|---|---|---|---|---|---|---|---|---|
| No. | 15 | 16 | 17 | 18 | 1 | 2 | 3 | 4 |
| Aliphatic dicarboxylic acid (A) | | | | | | | | |
| $A_1$ | adipic acid | adipic acid | adipic acid | adipic acid | sebacic acid | | oleic acid-triethanolamine soap | dimer acid-triethanolamine soap |
| $A_2$ | 1,16-hexadecanedicarboxylic acid | 1,16-hexadecanedicarboxylic acid | 1,16-hexadecanedicarboxylic acid | 1,16-hexadecanedicarboxylic acid | — | 1,18-octadecanedicarboxylic acid | — | — |
| $A_1/A_2$ | 1/1 | 1/1 | 1/1 | 1/1 | — | — | — | — |
| Nitrogen compound (B) | N—2-hydroxypropyltriethylenetetramine | trimethylenediamine/diethylenetriamine | methyliminobiopropylamine | tetramethylenediamine/diethylenetriamine (1.5/1.5) | diethylenetriamine | diethylenetriamine | — | — |
| Molar ratio (A/B) | 2/3 | 2/3 | 2/3 | 2/3 | 2/3 | 2/3 | — | — |
| Average molecular weight | 950 | 718 | 823 | 675 | 640 | 920 | — | — |
| Counter-anion | phosphoric acid | phosphoric acid | 1-hydroxyethylidene-1,1-diphosphonic acid | phosphoric acid | phosphoric acid | phosphoric acid | — | — |
| Water solubility[1] | S | S | S | S | S | D | S | S |
| Pressure resistance[2] ($Kg/cm^2$) | 20.0 | 20.0 | 20.0 | 20.0 | 13.0 | 20.0 | 6.5 | 17.5 |

INDUSTRIAL APPLICABILITY

The present invention can be utilized in the synthesis of a cationic compound by neutralizing a condensation product between an aliphatic dicarboxylic acid and an organic compound having at least two basic nitrogen atoms with a phosphorus oxy acid or a derivative thereof.

The present invention can be utilized in the production of a metal processing lubricant comprising this cationic compound.

The present invention can be utilized in processing a metal with this lubricant.

What is claimed is:

1. A metal processing composition which comprises a water-soluble cationic compound obtained by neutralizing a condensation product having an average molecular weight of 500 to 1000, which is obtained by reacting an aliphatic dicarboxylic acid having 6 to 16 carbon atoms or a dicarboxylic acid mixture comprising (A1) an aliphatic dicarboxylic acid having 6 to 16 carbon atoms and (A2) an aliphatic dicarboxylic acid having 17 to 22 carbon atoms at an (A1)/(A2) molar ratio of $\frac{1}{3}$ to 3/1 with at least one compound having at least two basic nitrogen atoms, which is selected from the group consisting of (a) compounds represented by the following general formula:

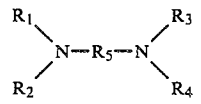

wherein $R_1$ through $R_4$ stand for H or an alkyl group having 1 to 3 carbon atoms, at least one of $R_1$ through $R_4$ stands for H, and $R_5$ stands for an alkylene group having 1 to 4 carbon atoms, (b) compounds represented by the following general formula:

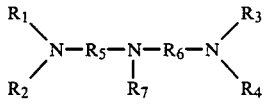

wherein $R_1$ through $R_4$ and $R_7$ stand for H or an alkyl group having 1 to 3 carbon atoms, at least one of $R_1$ through $R_4$ and $R_7$ stands for H, and $R_5$ and $R_6$ stand for an alkylene group having 1 to 4 carbon atoms, (c) compounds represented by the following general formula:

$$H_2N\text{-}(C_2H_4NH)_n\text{-}H$$

wherein n is an integer of from 3 to 5, and (d) hydroxyl group-containing basic nitrogen compounds selected from ethylaminoethanolamine, 1,2-bis(hydroxyethylamino)ethane, 1,3-diamino-2-propanol, 2-hydroxyethylaminopropylamine, N,N'-bis(hydroxyethyl)diethylenetriamine, 2-hydroxypropyltrimethylenetetramine and N-2-hydroxypropyltriethylenetetramine, with at least one phosphorus oxy acid selected from the group consisting of (1) phosphoric acid, phosphorous acid, hypophosphorous acid and perphosphoric acid, (2) a condensed phosphorus oxy acid selected from pyrophosphoric acid, trimetaphosphoric acid, tetrametaphosphoric acid, pyrophosphorous acid, polymetaphosphorous acid and diperphosphoric acid and (3) a compound selected from compounds represented by the following formulae (i) through (iii):

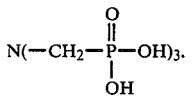

(i)

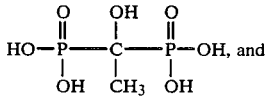

(ii)

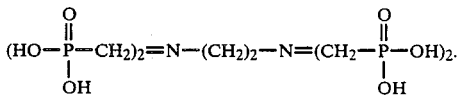

(iii)

* * * * *